US006230536B1

(12) United States Patent
Matsuoka

(10) Patent No.: US 6,230,536 B1
(45) Date of Patent: May 15, 2001

(54) NEGATIVE ANGLE-FORMING DIE

(75) Inventor: Mitsuo Matsuoka, Neyagawa (JP)

(73) Assignee: Umix Co., Ltd., Osaka (JP)

( * ) Notice: Subject to any disclaimer, the term of this patent is extended or adjusted under 35 U.S.C. 154(b) by 0 days.

(21) Appl. No.: 09/471,171

(22) Filed: Dec. 23, 1999

(30) Foreign Application Priority Data

Nov. 15, 1999 (JP) ..... 11-324073

(51) Int. Cl.[7] ..... B21D 5/04
(52) U.S. Cl. ..... 72/313; 72/387; 72/452.9
(58) Field of Search ..... 72/313–315, 388, 72/387, 319, 452.9

(56) References Cited

U.S. PATENT DOCUMENTS 4,535,619 * 8/1985 Gargrave ..... 72/313
5,347,838 * 9/1994 Matsuoka ..... 72/313
5,746,082 * 5/1998 Matsuoka ..... 72/452.9

FOREIGN PATENT DOCUMENTS 59-197318 * 11/1984 (JP) ..... 72/313

* cited by examiner

*Primary Examiner*—Daniel C. Crane
(74) *Attorney, Agent, or Firm*—Birch, Stewart, Kolasch & Birch, LLP

(57) ABSTRACT

A negative angle-forming die includes a lower die for mounting a thin metallic plate workpiece onto a supporting portion thereof, and an upper die descendable in a straight direction towards the lower die for forming the workpieces by abutting against the workpiece. A columnar body is arranged in a freely rotating manner on the lower die by a pair of spaced-apart bearings, and has an intruding forming portion formed at an edge portion thereof. A slide cam is formed with an intruding forming portion, and is arranged to oppose the columnar body in a freely sliding manner with respect to the lower die. An automatic returning tool is arranged at the lower die for retracting the columnar body in a rotating manner to an extent with which the workpiece can be taken out from the lower die upon completion of forming. The workpiece that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed workpiece can be taken out from the lower die. The negative angle-forming die includes a locking device for making the columnar body maintain a specified forming posture.

20 Claims, 11 Drawing Sheets

NEGATIVE ANGLE-FORMING DIE

BACKGROUND OF THE INVENTION

1. Field of the Invention

The present invention relates to a negative angle-forming die for forming metallic thin plates. In this context, a negative angle-forming die is used for forming in which a portion of a work is intruded into a lower die further than a descending locus in a straight direction of an upper die.

2. Description of the Background Art

Negative angle forming wherein a work of metallic thin plate is intruded into a lower die than a descending locus of an upper die in a straight manner is usually performed by using a slide cam.

A conventional method for performing intrusion forming of a work of metallic thin plate (a workpiece) included the steps of placing the work onto a lower die, descending an upper die downward in a vertical direction, driving a passive cam of the lower die by an active cam of the upper die for processing the work from a lateral direction, and after the upper die was raised upon completion of processing, the active cam was retracted by a spring.

In this case, a forming portion of the passive cam that forms the work by being slid from outside of the work in a lateral direction is uniformly formed to assume a shape that is identical to that of a forming portion of the work. However, since the work needs to be taken out from the lower die upon completion of processing, the forming portion of the lower die onto which the work is mounted is either arranged in that an intruding portion of the lower die is provided to be separable for retraction or in that a rear portion of the intruding portion is cut off and the work is moved forward for enabling the work to be taken out. While it does not become problematic in case of a minor degree of intrusion, in case such a degree is large or the work is a long and slender frame-like part having a grooved section such as a front pillar outer of metallic thin plate used in a vehicle, it may happen in case the intruding portion of the lower die is divided or cut off that, owing to the narrow groove width of the work, no clear shape can be formed by the forming portion of the passive cam and moreover, that insufficient strength of the lower die makes it impossible to perform intrusion forming at all.

Further, there are also cases in which torsions or warps are formed in products so that correction of products needs to be performed, while correction of products is practically impossible in case of parts constituting an outer panel portion of a vehicle such as a side panel, fender, roof, bonnet, trunk lid, door panel or front pillar outer all of which assume three-dimensional curved surfaces and curved lines. In case of assembling metallic thin plates for a vehicle, products which assume torsions or warps can be hardly combined to other parts, and it could not be provided for a structure of metallic thin plates for a vehicle of high quality and it could not be maintained for a specified degree of product accuracy required for the product of metallic thin plate.

For solving the above problems, it has been devised for an arrangement as follows for converting descending, straight movements of the upper die into rotational movements for rotating a columnar body, forming a forming portion that is intruded into the lower die further than a straightly descending locus of the upper die, and after completion of forming, retracting the columnar body in a rotating manner to an extent that a formed work can be taken out form the lower die.

That is, as shown in FIGS. 8 to 11, the negative angle-forming die is comprised of a lower die 102 for mounting a work W of metallic thin plate onto a supporting portion 101 thereof and an upper die 103 that is descended in a straight direction towards the lower die 102 for forming the work W by hitting against the work W, wherein there are further provided a columnar body 106 arranged in a freely rotating manner on the lower die 102 and having a groove 104 that is open to an outer peripheral surface and that is carved into an axial direction as well as an intruding forming portion 105 formed at an edge portion of the groove 104 closer to the supporting portion 101 that is intruded further than a locus of the upper die 103, a slide cam 108 formed with an intruding forming portion 107 being arranged on the upper die 103 in a freely sliding manner as to oppose the columnar body 106, and an automatic returning tool 109 arranged at the lower die 102 for retracting the columnar body 106 in a rotating manner to an extent with which the work W can be taken out from the lower die 102 upon completion of forming, wherein the work W that is mounted on the supporting portion 101 of the lower die 102 is formed through the intruding forming portion 105 of the columnar body 106 and the intruding forming portion 107 of the slide cam 108 while the columnar body 106 is rotated and the slide cam 108 performs sliding movements, and after completion of forming, the columnar body 106 is retracted in a rotating manner by the automatic returning tool 109 such that the formed work W can be taken out from the lower die 102.

Operations of such a negative angle-forming die will now be explained.

As shown in FIG. 8, the upper die 103 is first positioned at a top dead center at which time the work W is mounted on to the supporting portion 101 of the lower die 102. At this time, the columnar body 106 is retracted in a rotating manner by the automatic returning tool 109.

Next, the upper die 103 starts to descend, and as shown in FIG. 9, the slide cam 108 is first made to abut against a rotating plate 111 of the slide cam 108 without interfering the intruding forming portion 105 of the columnar body 106 so as to rotate the columnar body 106 in a rightward direction in FIG. 9 to put the columnar body 106 into a forming posture, and thereafter, a pad 110 pressurizes the work W.

When the upper die 103 keeps on descending, the slide cam 108 that is energized in a direction outside of the die moves leftward in a lateral direction of the drawing by the action of the cam against energizing force of a coil spring 112 to assume a condition as shown in FIG. 10, whereby intrusion forming of the work W is performed through the intruding forming portion 105 of the rotated columnar body 106 and the intruding forming portion 107 of the slide cam 108.

After intrusion forming is completed, the upper die 103 starts rising. The slide cam 108, being energized in a direction outside of the die by the coil spring 112, is moved rightward in FIG. 11 so that it can be raised without interfering the work W.

On the other hand, accompanying the rising movements of the slide cam 108 which had been constraining the columnar body 106, the columnar body 106 rotates leftward in FIG. 11 through the automatic returning tool 109. In this manner, when taking the work W out from the lower die 102 after intrusion forming, the work W can be taken out without interfering the intruding forming portion 105 of the columnar body 106.

In the above-described negative angle-forming process, a lower surface of the slide cam 108 that is energized by the coil spring 112 abuts against the rotating plate 111 that is energized by a coil spring 113 of the automatic returning tool 109 to rotate the columnar body 106 in a rightward direction such that the columnar body 106 assumes a forming posture whereupon the pad 110 pressurizes the work W. However, drawbacks are presented in that negative angle-forming processes of favorable quality cannot be performed in case the work W in the forming posture is rotated to some extent in the leftward direction in the drawing since the energizing force applied to the work W that is mounted on the pad 110 is too large, or in case the energizing force of the coil spring 112 of the slide cam 108 and that of the coil spring 113 of the automatic returning tool 109 are not balanced, whereby the columnar body 106 is slightly rotated such that it cannot maintain a specified forming posture to consequently result in a case in which a stepped portion is formed in a curved surface of the work W or in which no accurate straight line can be formed. Consequently, it becomes difficult to provide products of accuracy in units of 1/100 mm, and negative angle forming of favorable quality cannot be performed.

As it can be seen from FIGS. 8 to 11, the columnar body 106 is supported by the lower die 102 by directly contacting thereat except for the portion of the groove 104 whereby it is required to accurately perform processing of the columnar body 106 and a portion of the lower die 102 for supporting the columnar body 106 (a hole having a substantially circular section) so as to make processing difficult.

Moreover, the negative angle-forming die assumes a large dimension owing to its arrangement in which almost the entire outer periphery of the columnar body 106 is supported by the lower die 102 and the rotating plate 111 is formed as to extrude from the columnar body 106, whereby the mold becomes quite expensive.

SUMMARY OF THE INVENTION

The present invention has thus been made in view of these facts and for the purpose of providing formings of metallic thin plate of favorable quality by maintaining the columnar body in the specified forming posture, and although there were cases in which it could not be coped with cases in which a columnar body was slightly rotated such that it could not maintain a specified forming posture to consequently result in a case in which a stepped portion was formed in a curved surface of a work, in which no accurate straight line could be formed, or in which it became difficult to provide products having accuracy in units of 1/100 mm such that no formings of metallic thin plate of favorable quality could be provided, the negative angle-forming die of the present invention is comprised with a lower die for mounting a work of metallic thin plate onto a supporting portion thereof and an upper die that is descended in a straight direction towards the lower die for forming the work by hitting against the work, wherein there are further provided a columnar body arranged in a freely rotating manner on the lower die and having an intruding forming portion which is intruded further than a locus of the upper die formed at an edge portion closer to the supporting portion, a slide cam formed with an intruding forming portion, being arranged as to oppose the columnar body in a freely sliding manner with respect to the lower die, and an automatic returning tool arranged at the lower die for retracting the columnar body in a rotating manner to an extent with which the work can be taken out from the lower die upon completion of forming, wherein the work that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed work can be taken out from the lower die, wherein the forming mold is a negative angle-forming die comprised with a locking device for making the columnar body maintain a specified forming posture.

The locking device according to the present invention is particularly arranged in that the columnar body is locked by an action of a cylinder.

The locking device according to the present invention is particularly arranged in that the columnar body is locked by connection between an extruding piece of the columnar body and a locking block formed at a tip of a piston rod of an air cylinder.

Moreover, the locking device according to the present invention is particularly arranged in that connecting surfaces of both, the extruding piece and the locking block, are formed as tapered surfaces wherein a surface opposite to the tapered surface of the locking block is formed as a sliding surface for sliding on the lower die.

In an alternative form of the present invention which aims to assume a simple structure in which an entire periphery of the columnar body is not supported by the lower die, the negative angle-forming die is comprised with a lower die for mounting a work of metallic thin plate onto a supporting portion thereof and an upper die that is descended in a straight direction towards the lower die for forming the work by hitting against the work, wherein there are further provided a columnar body arranged in a freely rotating manner on the lower die and having an intruding forming portion which is intruded further than a locus of the upper die formed at an edge portion closer to the supporting portion, a slide cam formed with an intruding forming portion, being arranged as to oppose the columnar body in a freely sliding manner with respect to the lower die, and an automatic returning tool arranged at the lower die for retracting the columnar body in a rotating manner to an extent with which the work can be taken out from the lower die upon completion of forming, wherein the work that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed work can be taken out from the lower die, wherein the forming die is a negative angle-forming die arranged as to support the columnar body by a bearing in a freely rotating manner.

The negative angle-forming die according to the present invention is particularly arranged in that both ends of the columnar body are supported by the bearing in a freely rotating manner.

Moreover, the negative angle-forming die according to the present invention is particularly arranged in that a flexible columnar body is supported also on a distance between both ends.

In an alternative form of the present invention in which the columnar body does not assume a substantially circular section but a fan-like section having a central angle that is as small as possible in order to realize down-sizing of the negative angle-forming die that can be distributed at low costs, the negative angle-forming die is comprised with a lower die for mounting a work of metallic thin plate onto a supporting portion thereof and an upper die that is descended in a straight direction towards the lower die for forming the work by hitting against the work, wherein there are further provided a columnar body arranged in a freely rotating manner on the lower die and having an intruding forming portion which is intruded further than a locus of the upper die formed at an edge portion closer to the supporting portion, a slide cam formed with an intruding forming portion, being arranged as to oppose the columnar body in a freely sliding manner with respect to the lower die, and an automatic returning tool arranged at the lower die for retracting the columnar body in a rotating manner to an extent with which the work can be taken out from the lower die upon completion of forming, wherein the work that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed work can be taken out from the lower die, wherein the forming die is a negative angle-forming die wherein a connecting portion between the columnar body and the lower die is formed to be substantially a quarter of the circumference.

In the present invention, the columnar body is particularly arranged in that it abuts against a hitting surface of the lower die.

Moreover, in the present invention, a negative angle-forming portion of the columnar body is disposed on an opposing side with respect to its outer peripheral surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENT

The present invention will now be explained in details based on particular embodiments as shown in the accompanying drawings.

Figure 1A:
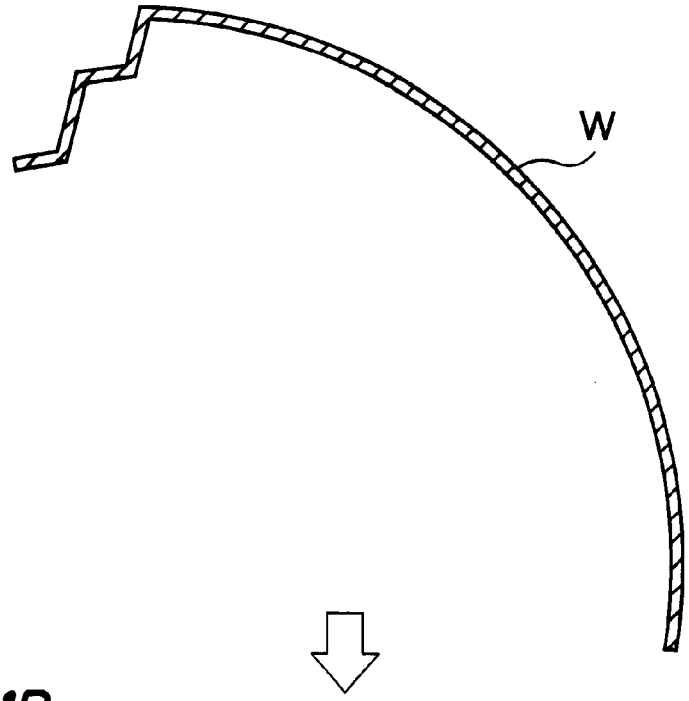
FIGS. 1A and 1B are two sectional views of a metallic thin plate part for a vehicle that is formed by using the negative angle-forming die of the present invention, one before and one after processing.
Figure 1B:
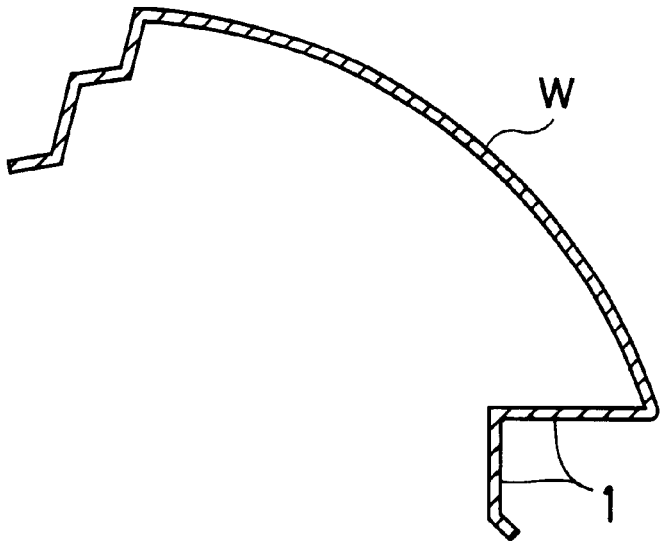

FIG. 1 is a sectional view showing a metallic thin plate part for a vehicle that is formed by using the negative angle-forming die of the present invention, one before and one after processing, wherein a lower portion of work W as shown in FIG. 1(*b*) is an intruding forming portion 1.

This part assumes three-dimensional curved surfaces and curved lines for composing outer panel portions of a vehicle.

Figure 2:
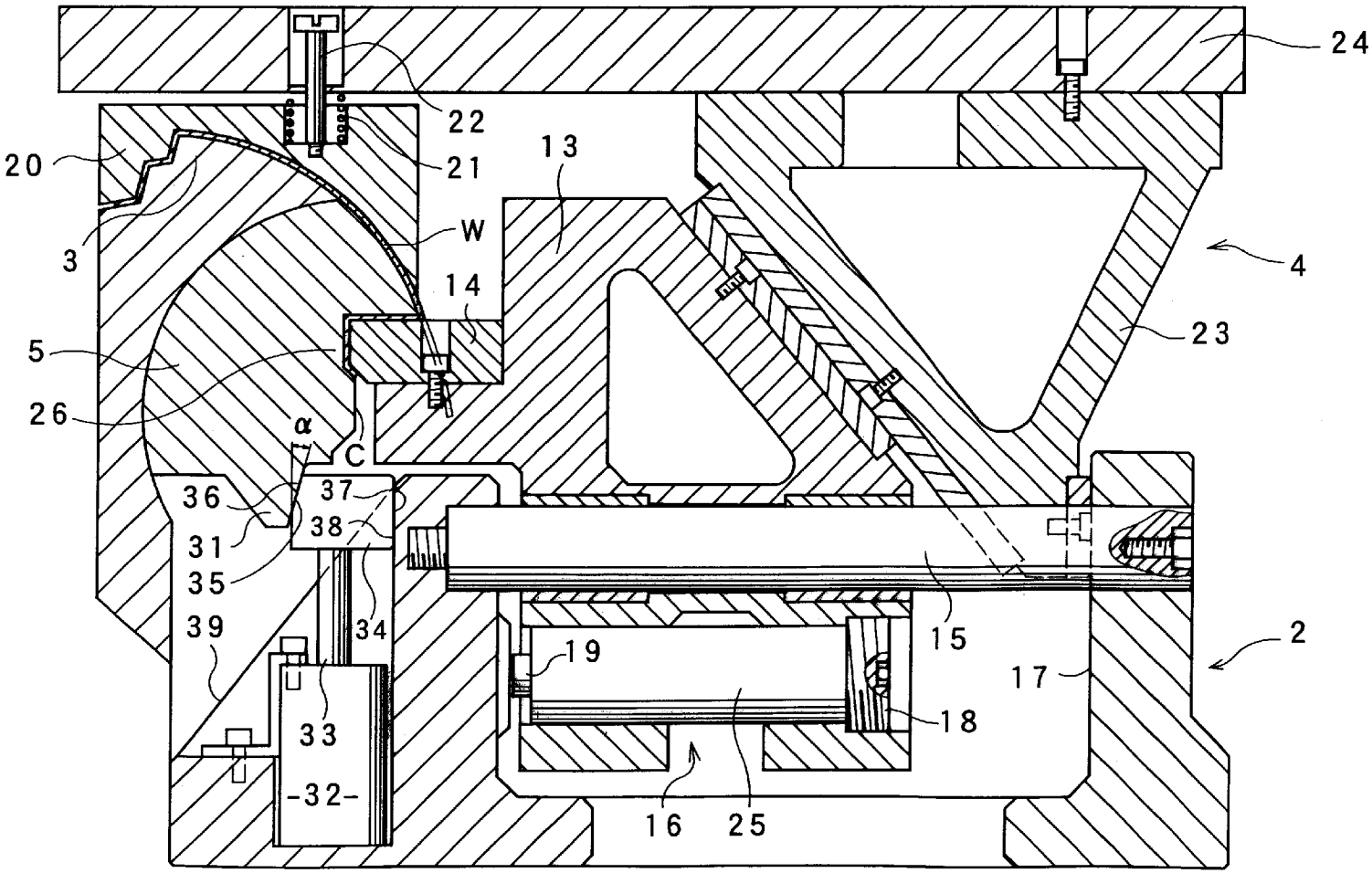
FIG. 2 is a longitudinal sectional view showing a condition in which the upper die through which intrusion forming of the metallic thin plate part as shown in FIG. 1 is performed has descended to a bottom dead center.

In FIG. 2, a lower die 2 is formed with a supporting portion 3 for the work W located on a leftward upper side when facing the drawing, and a columnar body 5, which is formed with an intruding forming portion 26 being formed at an edge portion on a side of the supporting portion 3 such that it intrudes further than a locus of an upper die 4, is provided on the lower die 2 in a freely rotating manner. Reference C denotes a center of rotation for the columnar body 5. In order to enable taking out of the work W from the lower die 2 after forming the work W, an air cylinder 6 is provided at the lower die 2 as an automatic returning tool for retracting the columnar body in a rotating manner.

Figure 3:
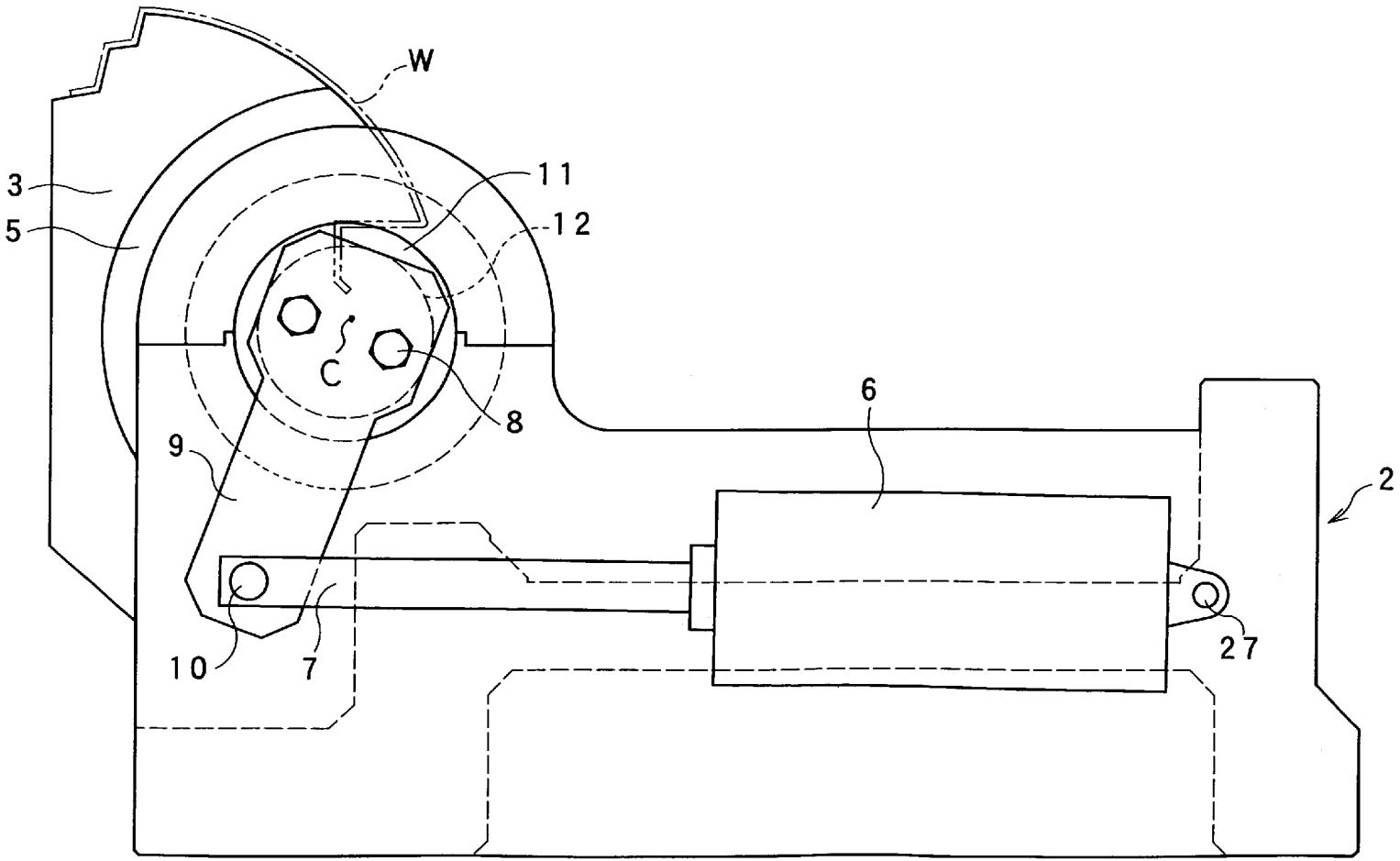
FIG. 3 is a side view showing a condition in which an air cylinder which functions to automatically return a columnar body of the present invention has been attached.

As shown in FIG. 3, a tip portion of a piston rod 7 of the air cylinder 6 that is connected to the lower die 2 via a pin 27 is connected, by means of a pin 10, to a link 9 fixed, via a bolt 8, to an end surface of a supporting shaft 12 that is fixedly attached to an outer end of the columnar body 5 while being supported by a bearing 11 in a freely rotating manner. The automatic returning tool may be, besides an air-pressure device as described above, a pushing pin that is energized by a coil spring, a hydraulic device, a link mechanism, a cam or any similar mechanism.

Figure 5:
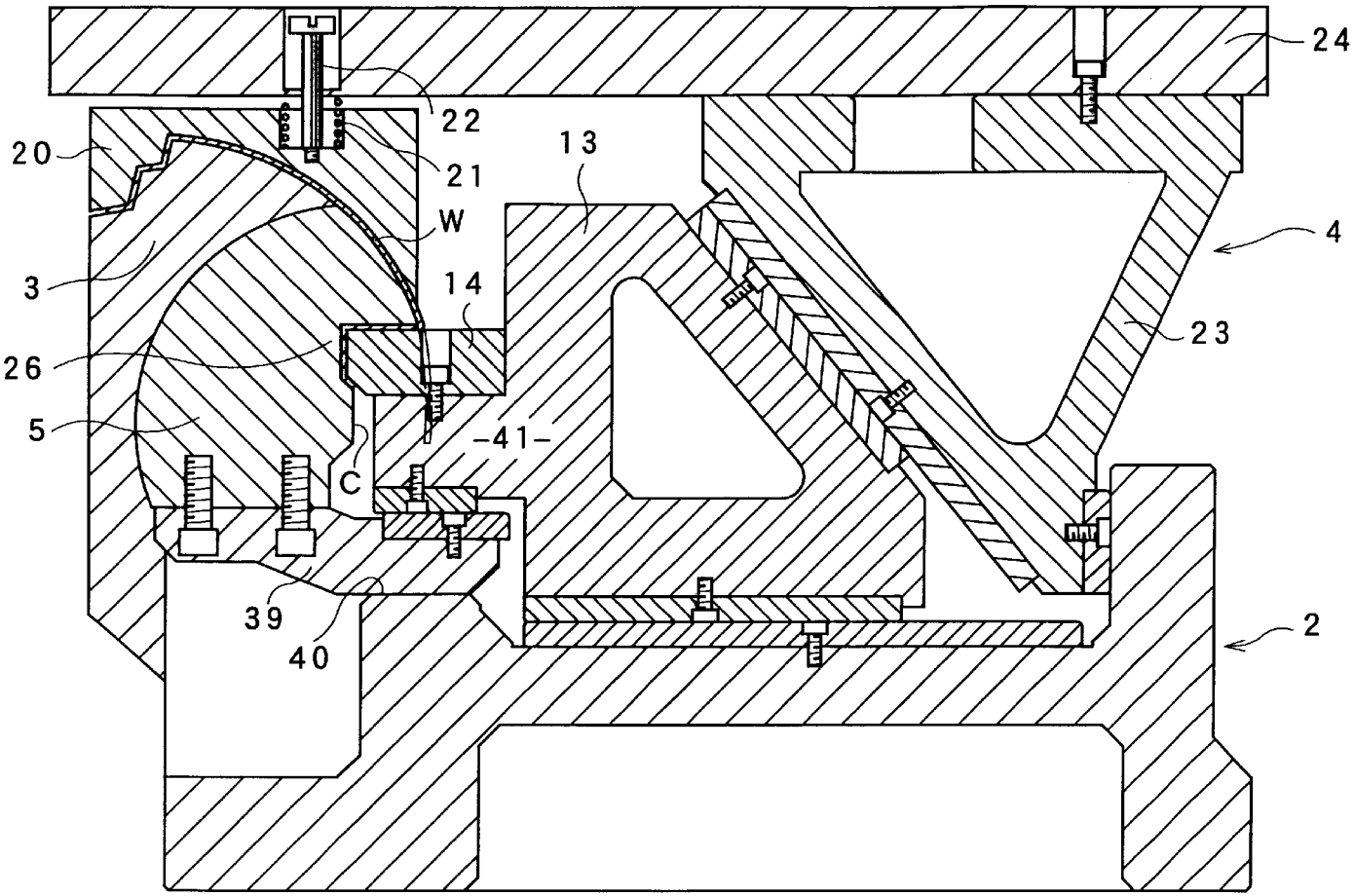
FIG. 5 is a longitudinal sectional view showing a condition of a bottom dead center in which a product of the present invention has undergone intrusion processing.
Figure 6:
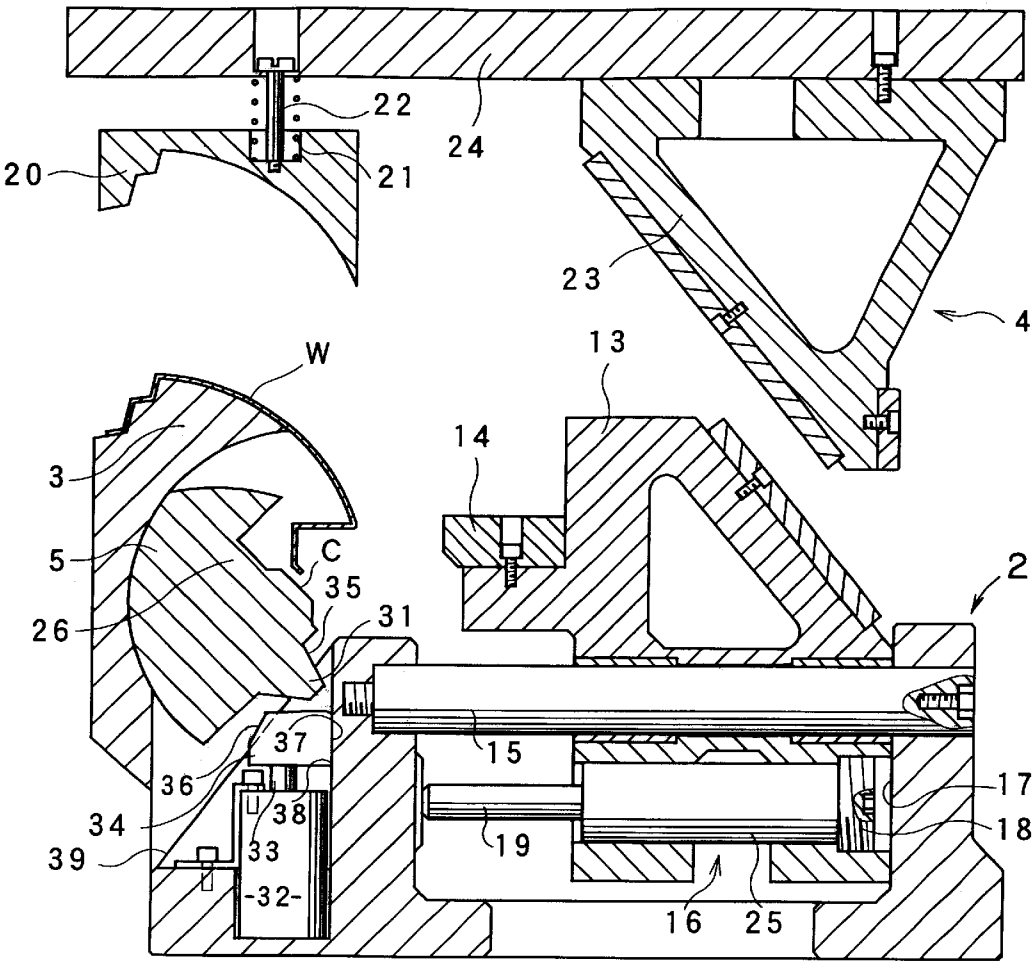
FIG. 6 is a longitudinal sectional view showing FIG. 2 after processing in which the upper die has been raised to be at a top dead center.

As shown in FIG. 2, the lower die 2 is further provided with a slide cam 13 that is positioned as to oppose the columnar body 5 and which performs sliding movements. The slide cam 13 is formed with an intruding forming portion 14 at an upper portion of a tip that is closer to the columnar body 5, and by guiding the slide cam 13 through a guide post 15 or, as shown in FIG. 5, through sliding a lower surface thereof, the slide cam 13 is energized in a direction to outside of the mold (a direction receding from the columnar body 5) by a gas spring 16 that is disposed between the slide cam 13 and the lower die 2. The slide cam 13 is terminated at a terminating surface 17 of the lower die 2 as shown in FIG. 6. It should be noted that the gas spring 16 supports reaction force of energizing force actuated by the rod 19 by using a plug 18 that is screwed to the gas spring 16.

The gas spring 16 accumulates in a cylinder 25 thereof high-pressure gas, e. g. high-pressure gas of 150 kg/cm$^2$, depending to various purposes, and even though a rod 19 extruding from the cylinder 25 is expanded or retracted, a substantially constant output of, e.g. 150 kg/cm$^2$, can be obtained during the entire length of the expanding and retracting process of the rod. The substantially constant output can be achieved during the entire process of the rod 19 through two tanks that are incorporated within the cylinder 25 wherein in case the rod 19 is retracted and pressure is applied to one tank, high-pressure gas is made to flow out from this tank to flow into the other tank.

In this manner, the gas spring 16 is capable of performing high output from the start of actuation and during the entire process unlike a case with a coil spring whereby the slide cam 13 can be reliably returned to ensure safety.

Further, by the use of the gas spring 16, the slide cam 13 is enabled to move a distance as long as 150 mm, and processing of a large-sized work such as a side panel of metallic thin plate used in a vehicle is also enabled.

A pad 20 is energized in a downward direction by the coil spring 21 and suspended at the upper die 4 via a suspending bolt 22 which functions to press the work W strongly against the lower 2 such that the work W does not move after the columnar body 5 has been positioned to assume a forming posture and before intrusion forming is started.

Further, an active cam 23 is fixedly attached to an upper die substrate 24 of the upper die 4 at a portion at which it opposes the slide cam 13 of the lower die 2.

In the negative angle-forming die of the present invention, it has been provided a locking device for preventing the columnar body 5 from rotating not to the slightest degree with the aim to provide formings of metallic thin plate of favorable quality at accuracy in units of 1/100 mm.

Figure 4:
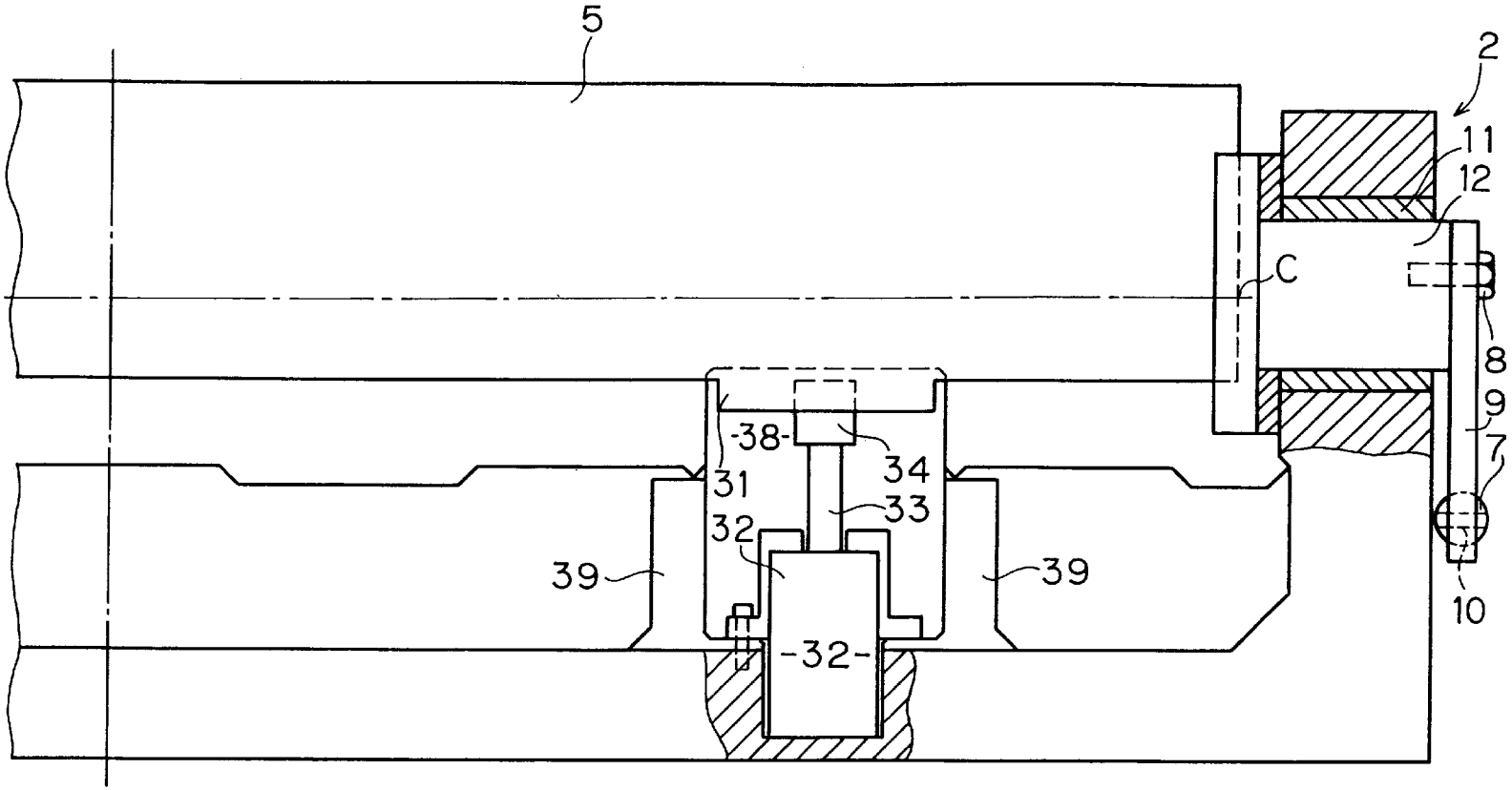
FIG. 4 is a front view in which a part of FIG. 3 has been cut off.
Figure 7:
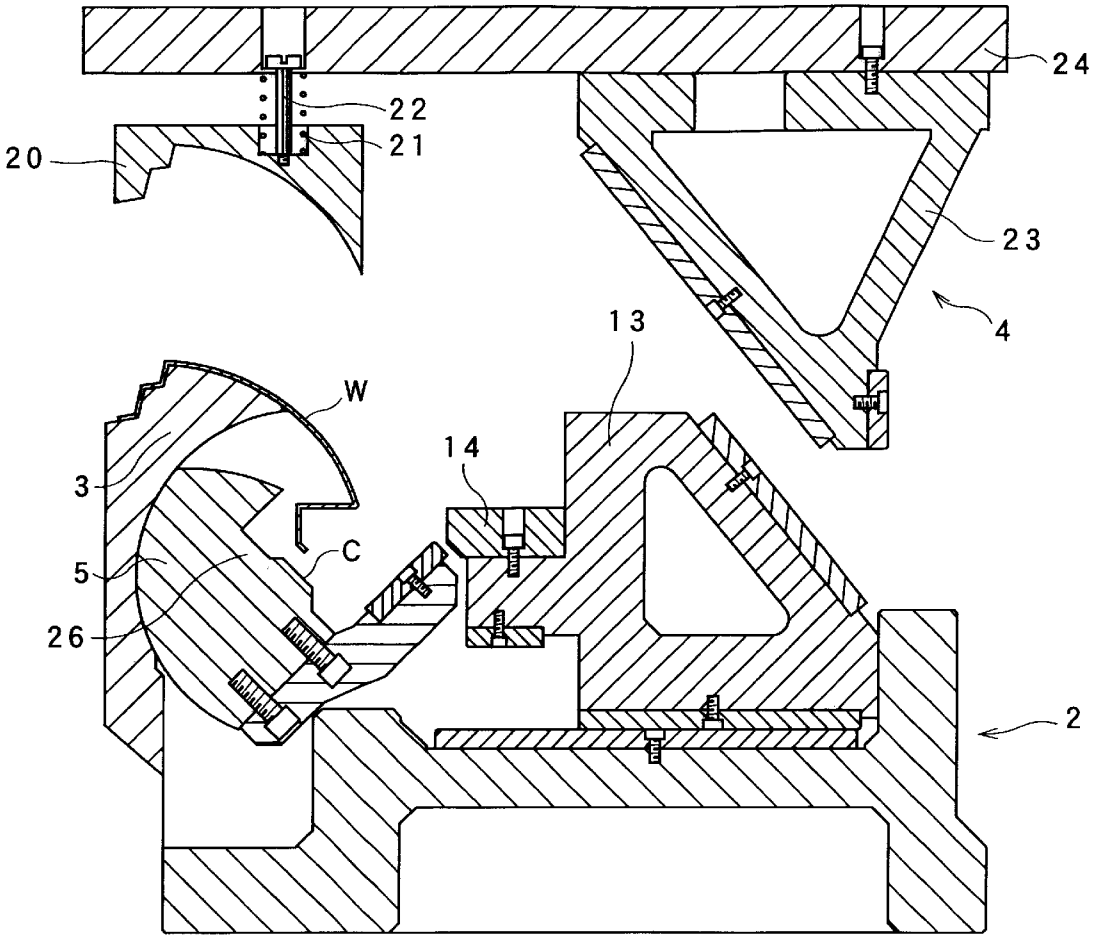
FIG. 7 is a longitudinal sectional view showing FIG. 5 after processing in which the upper die has been raised to be at the top dead center.
Figure 8:
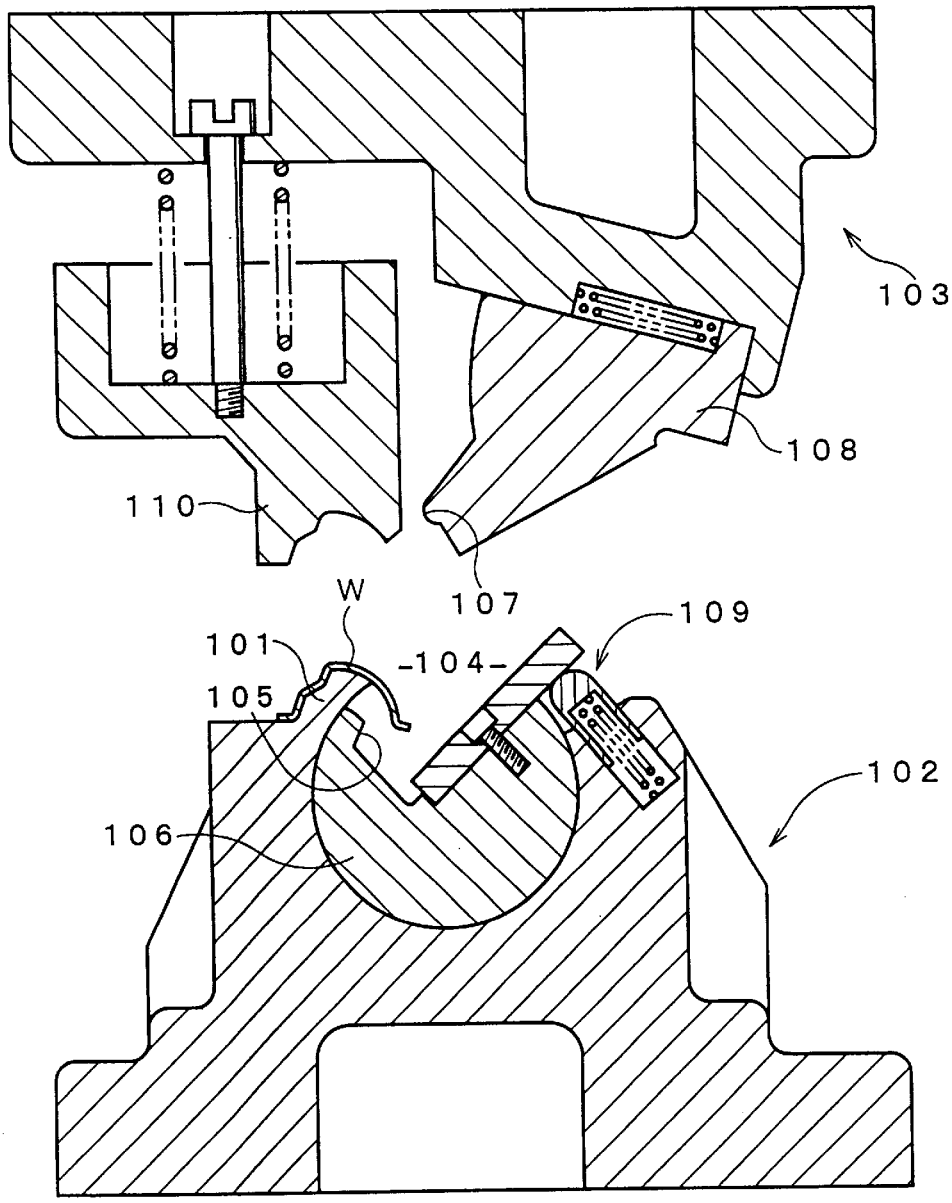
FIG.8 CONVENTIONAL ART
FIG. 8 is a longitudinal sectional view showing a conventional negative angle-forming die for performing intrusion forming which upper die is at a top bottom center.
Figure 9:
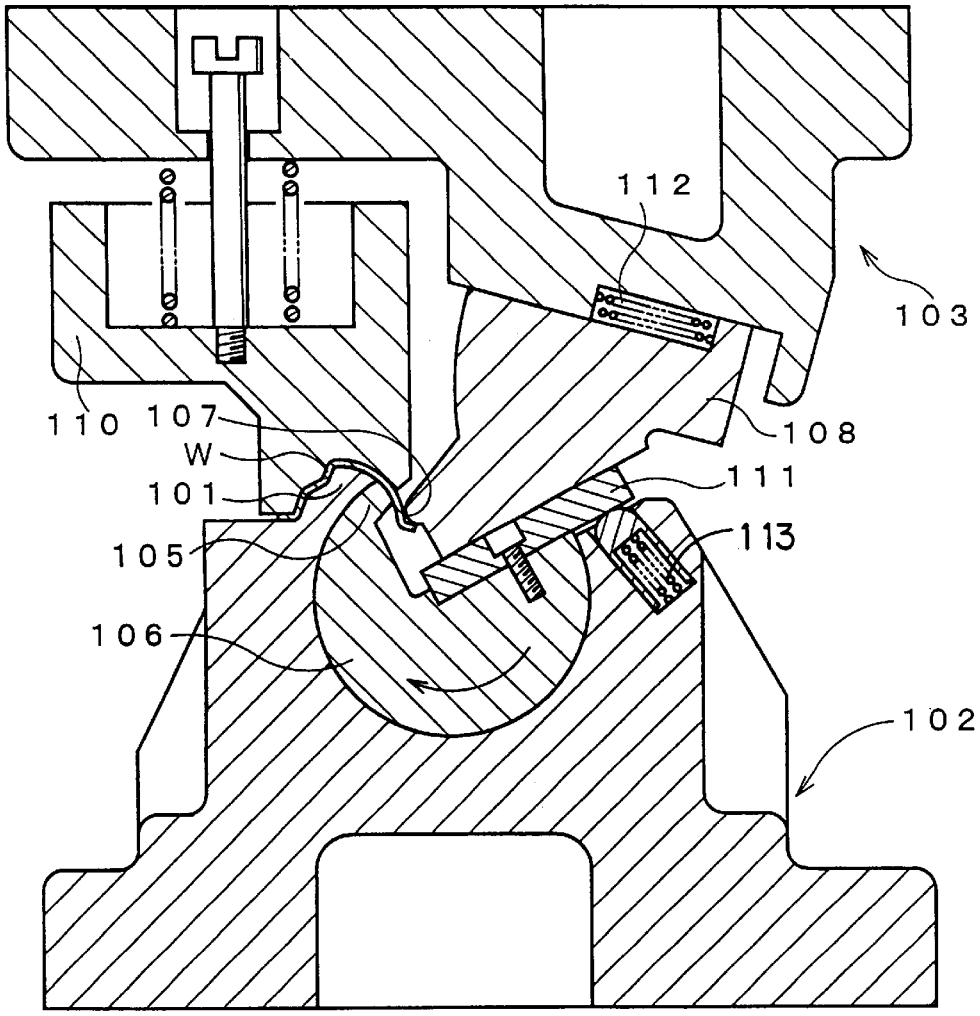
FIG.9 CONVENTIONAL ART
FIG. 9 is a longitudinal sectional view showing a condition in which the upper die of the conventional negative angle-forming die of FIG. 8 has descended to abut against its lower die and started to contact a work.
Figure 10:
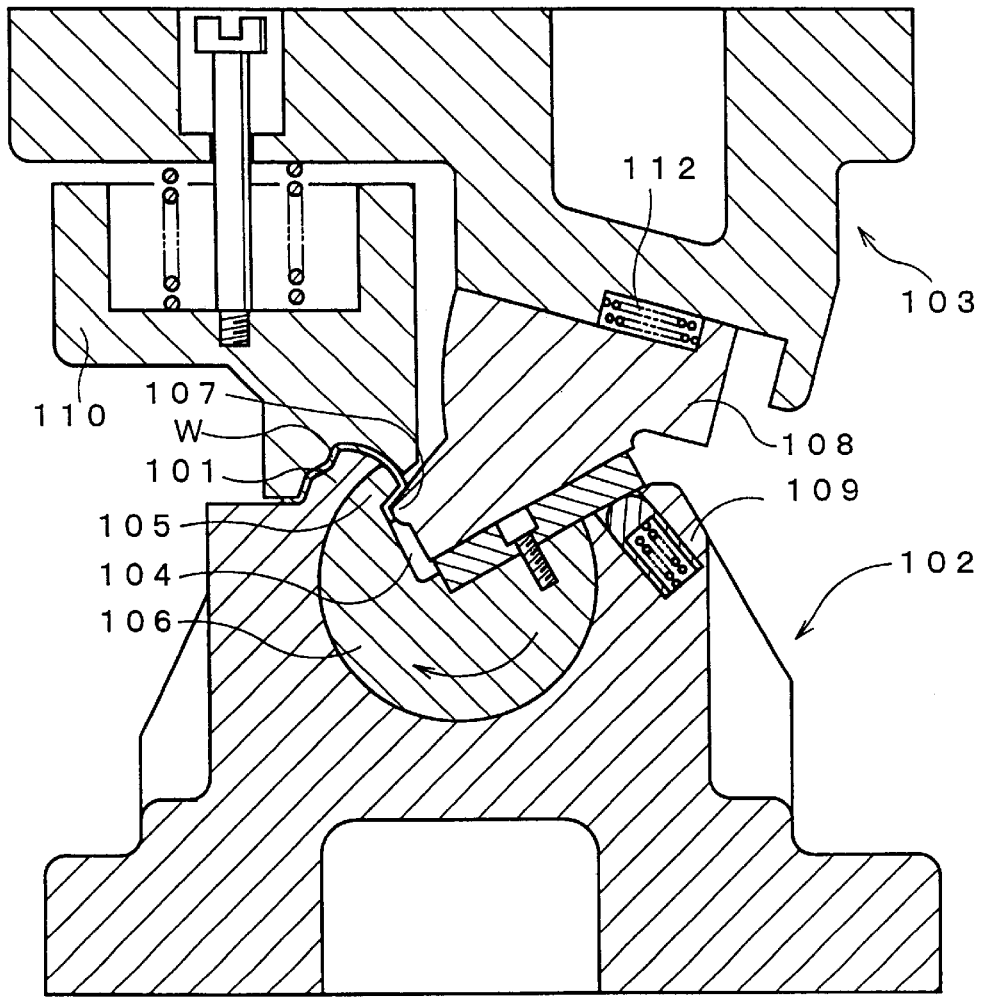
FIG. 10 CONVENTIONAL ART
FIG. 10 is a longitudinal sectional view showing a condition in which the upper die of the conventional negative angle-forming die of FIG. 8 is at a bottom dead center.
Figure 11:
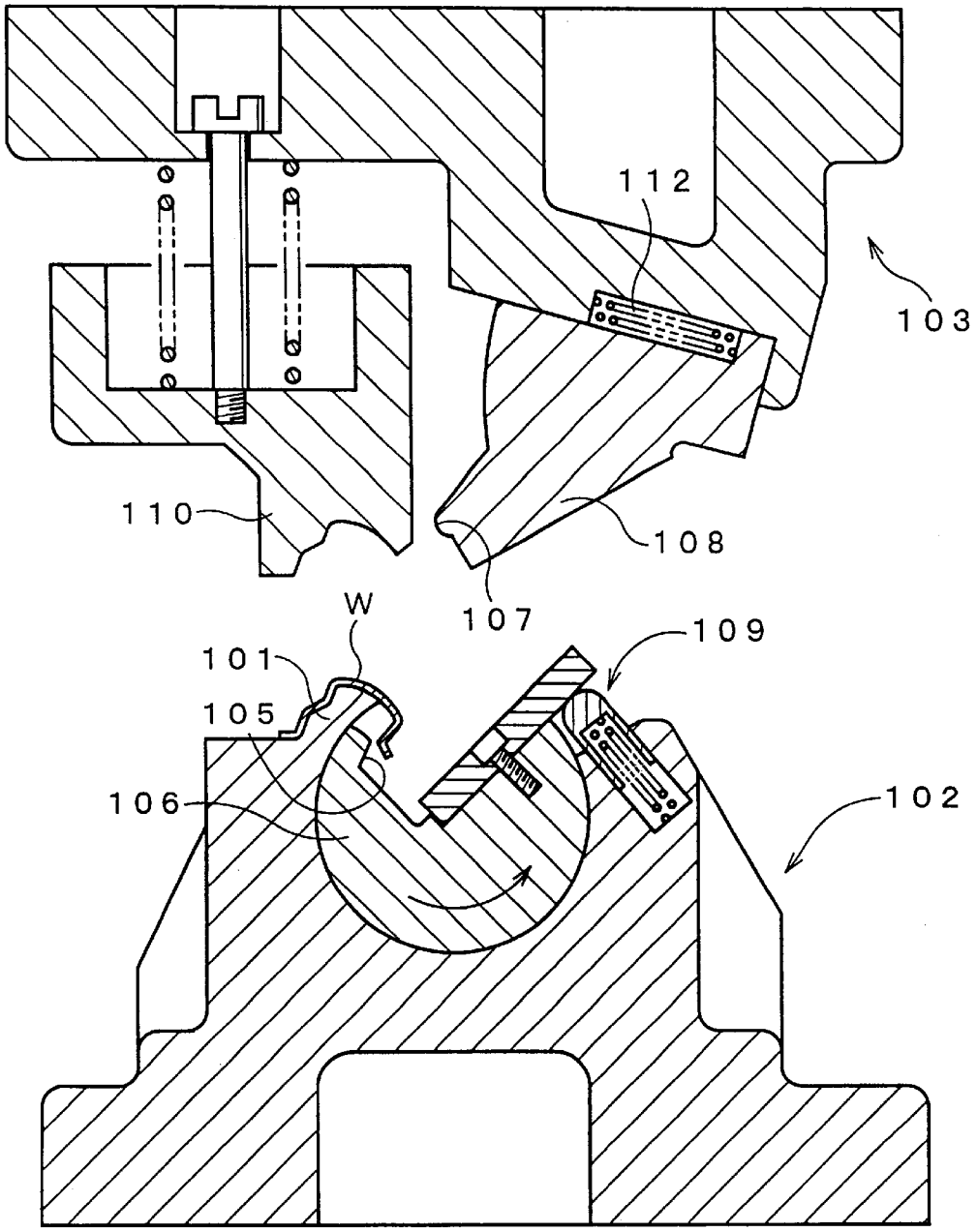
FIG.11 CONVENTIONAL ART
FIG. 11 is a longitudinal sectional view showing a condition in which the upper die of the conventional negative angle-forming die of FIG. 8 has been raised to be at the top dead center after performing intrusion forming.

As shown in FIG. 2, FIG. 4 and FIG. 7, an extruding piece 31 of a substantially triangle shape is made to extrude from a lower portion of the columnar body 5, an air cylinder 32 is disposed below, a locking block 34 is fixedly attached to a tip end of a piston rod 33 of the cylinder, and a contacting surface 35 of the extruding piece 31 and a contacting surface 36 of the locking block 34 are made to contact. A sliding surface 37 that is located opposite to the contacting surface 36 of the locking block 34 is made to abut against a vertical sliding surface 38 of the lower die 2. Further, a rib 39 is formed in proximity of the sliding surface 38 of the lower die 2 for satisfactory reinforcement purposes.

When the work W is mounted on the supporting portion 3 of the lower die 2 and the upper die 4 is descended, the columnar body 5 is made to assume a condition as shown in FIG. 2 through the air cylinder 6, and the columnar body 5 assumes a forming posture. The piston rod 33 of the air cylinder 32 is expanded as shown in FIG. 2, and the tapered contacting surface 36 of the locking block 34 of the rod is made to abut against the contacting surface 35 of the extruding piece 31 of the columnar body 5, and the sliding surface 37 of the locking block 34 is made to abut against the sliding surface 38 of the lower die 2 so as to prevent the columnar body 5 from moving to the slightest degree.

As shown in FIG. 2, a wedge of the locking block 34 intrudes into a space that is formed by the contacting surface 35 of the extruding piece 31 of the columnar body 5 and the sliding surface 38 of the lower die 2, and the columnar 5 is completely prevented from rotating even to the slightest degree. Therefore, it can be prevented that stepped portions are formed in curved surfaces of a work W or that curved line become inaccurate, and negative angle-forming processes of favorable quality can be performed at accuracy of units of 1/100 mm.

In case a tapering angle $\alpha$ of the locking block 34 is too small, intruding force of the looking block 34 becomes too large so that a large extruding force is required at the time of extruding, and in case the tapering angle $\alpha$ is too large, it becomes more difficult to maintain the columnar body 5 at its position, so that a proper size for the tapering angle $\alpha$ is selected.

After positioning the columnar body 5 at a forming posture for the locking block 34, the upper die 4 is descended to make the slide cam 13 approach the work W.

The upper die 4 is further descended, and the slide cam 13 is made to abut against a lower end portion of the work W by the active cam 23 to assume a condition of FIG. 2 at a bottom dead center. The work W is accordingly formed by the intruding forming portion 14 of the slide cam 13 and the intruding forming portion 26 of the columnar body 5. Even if the intruding forming portion 14 of the slide cam 13 should hit against a portion that is above the center C of the columnar body 5, the extruding piece 31 that is located lower than the center C of the columnar body 5 contacts the locking block 34 so that the columnar body 5 can be prevented from moving.

A tapering fit between the extruding piece 31 and the locking block 34 provides a fit condition with no space formed between so that the columnar body 5 does not move at all. Even if the tapered surface 35 of the extruding piece 31, the tapered surface 36 and the sliding surface 37 of the locking block 34, and the sliding surface 38 of the lower die 2 should be worn during usage, the stroke of the piston rod 33 of the air cylinder 32 is simply expanded slightly, and the columnar body 5 is not permitted to move anyway.

After completion of forming a negative angle, the upper die 4 is raised, the air cylinder 6 actuated, and as shown in FIG. 6, the slide cam 13 is retracted upon expansion of the rod 19 of the gas spring 16 such that the slide cam 13 is made to abut against the terminating surface 17 of the lower die 2, and by actuation of the air cylinder 6, the columnar body 5 is retracted in a rotating manner to a condition as shown in FIGS. 6 and 7, whereby the work W can be taken out from the lower die 2 without interfering with the columnar body 5. It should be noted that the columnar body 5 is rotated into the forming posture around the center C in FIG. 6, while it does not happen that it interferes with the locking block 34.

The negative angle-forming die according to another embodiment assumes an even simpler arrangement wherein the columnar body 5 is not supported by the lower die 2 over the entire circumference thereof.

As shown in FIG. 4, instead of supporting the outer periphery of the columnar body over the entire circumference thereof as it was conventionally the case, a supporting shaft 12 is fixedly attached to both ends of the columnar body 5 in an extruding manner and the supporting shaft 12 is inwardly fitted to the bearing 11 that is outwardly fitted to the lower die 2 to achieve a simple structure. In case the columnar body 5 becomes as large as 1,200 m and flex may become large, a distance between both ends of the columnar body 5 is suitably supported by a plurality of supporting bodies (not shown).

Further, the columnar body 5 of the present negative angle-forming die is arranged to assume a fan-like section having a central angle that is as small as possible, whereby down-sizing of the negative angle-forming die can be achieved to provide the negative angle-forming die at low costs.

In FIG. 5, the columnar body 5 is formed with an intruding forming portion 26 that is formed in a concave manner to be located above a center C of the columnar body 5 and a transmitting plate 39 is fixedly attached to below of the columnar body 5 wherein the transmitting plate is made to abut against a hitting surface 40 of the lower die 2. Columnar bodies of conventional negative angle-forming dies were supported by the lower die 2 over the entire outer peripheral surface thereof, whereby the negative angle-forming dies became large and costly. The negative angle-forming die of the present invention is arranged in that a connecting portion between the columnar body 5 and the lower die 2 is made to be a quarter of the circumference. In order to decrease the size of the columnar body 5 as much as possible, the intruding forming portion 26 of the columnar body 5 is located above the center C of the columnar body 5 so that the columnar body 5 as well as a portion of the lower die 2 which supports the columnar body 5 can be made to be a quarter of the circumference (a fan-like section which central angle is substantially 90°) Further, pressuring force that is applied by the intruding forming portion 14 of the slide cam 13 is made to face oblique upward whereby a lower surface of the transmitting plate 39 is made to abut against the hitting surface 40 of the lower die 2 so that it can receive the reaction force of the pressing force, and an extruding portion 41 of the slide cam 13 for supporting the intruding forming portion 14 is made to abut against an upper surface of the transmitting plate 39. With this arrangement, pressuring force for forming can be received by the lower die 2 so as to perform negative forming process in a clear manner.

Upon completion of the negative angle-forming process, the upper die 4 is raised as shown in FIG. 7, the slide cam 13 is made to retract by the energizing force of the gas spring 16, the columnar body 5 is retracted in a rotating manner by the action of the air cylinder 6, and the work W can be taken out from the lower die 2 without interfering with the columnar body 5.

As explained above, the negative angle-forming die according to the present is comprised with a lower die for mounting a work of metallic thin plate onto a supporting portion thereof and an upper die that is descended in a straight direction towards the lower die for forming the work by hitting against the work, wherein there are further provided a columnar body arranged in a freely rotating manner on the lower die and having an intruding forming portion which is intruding further than a locus of the upper die is formed at an edge portion closer to the supporting portion, a slide cam formed with an intruding forming portion, being arranged as to oppose the columnar body in a freely sliding manner with respect to the lower die, and an automatic returning tool arranged at the lower die for retracting the columnar body in a rotating manner to an extent with which the work can be taken out from the lower die upon completion of forming, wherein the work that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed work can be taken out from the lower die, wherein the forming die is a negative angle-forming die comprised with a locking device for making the columnar body maintain a specified forming posture. With this arrangement, it has been enabled to cope with cases in which a columnar body is slightly rotated such that it can not maintain a specified forming posture to consequently result in a case in which a stepped portion is formed in a curved surface of a work or in which no accurate straight line can be formed or in which it becomes difficult to provide products having an accuracy in units of 1/100 mm such that no formings of metallic thin plate of favorable quality could be provided, and to provide formings of metallic thin plate of favorable quality by maintaining the columnar body in the specified forming posture.

The locking device according to the present invention is particularly arranged in that the columnar body is locked by an action of a cylinder, whereby formings of metallic thin plate of favorable quality can be provided.

The locking device according to the present invention is particularly arranged in that the columnar body is locked by connection between an extruding piece of the columnar body and a locking block formed at a tip of a piston rod of an air cylinder, whereby formings of metallic thin plate of favorable quality can be provided.

The locking device according to the present invention is particularly arranged in that connecting surfaces of both, the extruding piece and the locking block, are formed as tapered surfaces wherein a surface opposite to the tapered surface of the locking block is formed as a sliding surface for sliding on the lower die. With this arrangement, formings of metallic thin plate of favorable quality can be provided.

Another negative angle-forming die of the present invention is comprised with a lower die for forming a work of metallic thin plate onto a supporting portion thereof and an upper die that is descended in a straight direction towards the lower die for forming the work by hitting against the work, wherein there are further provided a columnar body arranged in a freely rotating manner on the lower die and having an intruding forming portion which is intruding than a locus of the upper die is formed at an edge portion closer to the supporting portion, a slide cam formed with an intruding forming portion, being arranged as to oppose the columnar body in a freely sliding manner with respect to the lower die, and an automatic returning tool arranged at the lower die for retracting the columnar body in a rotating manner to an extent with which the work can be taken out from the lower die upon completion of forming, wherein the work that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed work can be taken out from the lower die, wherein the forming die is a negative angle-forming die arranged as to support the columnar body by a bearing in a freely rotating manner. With this arrangement, a simple structure is obtained in which an entire periphery of the columnar body is not necessary to be supported by the lower die.

The negative angle-forming die according to the present invention is particularly arranged in that both ends of the columnar body are supported by the bearing in a freely rotating manner, whereby the negative angle-forming die can be made of a simple structure.

Moreover, the negative angle-forming die according to the present invention is particularly arranged in that a flexible columnar body is supported also on a distance between both ends, whereby the negative angle-forming die can be made of a simple structure.

Another negative angle-forming die of the present invention is comprised with a lower die for mounting a work of metallic thin plate onto a supporting portion thereof and an upper die that is descended in a straight direction towards the lower die for forming the work by hitting against the work, wherein there are further provided a columnar body arranged in a freely rotating manner on the lower die and having an intruding forming portion which is intruding than a locus of the upper die is formed at an edge portion closer to the supporting portion, a slide cam formed with an intruding forming portion, being arranged as to oppose the columnar body in a freely sliding manner with respect to the lower die, and an automatic returning tool arranged at the lower die for retracting the columnar body in a rotating manner to an extent with which the work can be taken out from the lower die upon completion of forming, wherein the work that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed work can be taken out from the lower die, wherein the forming die is a negative angle-forming die wherein a connecting portion between the columnar body and the lower die is formed to be substantially a quarter of a circumference. With this arrangement, instead of assuming a substantially circular section, the columnar body can be formed to assume a fan-like section having a central angle that is as small as possible in order to realize downsizing of the negative angle-forming die that can be distributed at low costs.

In the present invention, the columnar body is particularly arranged in that it abuts against a hitting surface of the lower die, whereby downsizing of the negative angle-forming die can be realized that can be distributed at low costs.

Moreover, in the present invention, a negative angle-forming portion of the columnar body is disposed on an opposing side with respect to its outer peripheral surface, whereby downsizing of the negative angle-forming die can be realized that can be distributed at low costs.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A negative angle-forming die comprising:

a lower die for mounting a thin plate workpiece onto a supporting portion thereof;

an upper die descendable in a straight direction towards the lower die for forming the workpiece by abutting against the workpiece;

a columnar body arranged in a freely rotating manner on the lower die, said columnar body having an intruding forming portion formed at an edge portion thereof;

a slide cam having an intruding forming portion, said slide cam being arranged to oppose the columnar body in a freely sliding manner with respect to the lower die;

an automatic returning tool arranged at the lower die for retracting the columnar body in a rotating manner to an extent with which the workpiece can be taken out from the lower die upon completion of forming, wherein the workpiece that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed workpiece can be taken out from the lower die; and a locking device for making the columnar body maintain a specified forming posture.

2. The negative angle-forming die as claimed in claim 1, wherein the locking device includes a cylinder.

3. The negative angle-forming die as claimed in claim 1, wherein the locking device includes a locking block formed at a tip of a piston rod of an air cylinder, said locking block engageable with an extruding piece of said columnar body to lock the columnar body in said specified forming posture.

4. The negative angle-forming die as claimed in claim 3, wherein connecting surfaces of both the extruding piece and the locking block are formed as tapered surfaces, and wherein a surface opposite to the tapered surface of the locking block is formed as a sliding surface for sliding on the lower die.

5. The negative angle-forming die as claimed in claim 1, further comprising:

a first cylindrical bearing support surface located in said lower die;

a second cylindrical bearing support surface located in said lower die;

a first cylindrical shaft located at a first end of said columnar body;

a second cylindrical shaft located at a second end of said columnar body;

a first cylindrical bearing located between said first cylindrical bearing support and said first cylindrical shaft for supporting said first end of said columnar body in a freely rotating manner; and a second cylindrical bearing located between said second cylindrical bearing support and said second cylindrical shaft for supporting said second end of said columnar body in a freely rotating manner.

6. The negative angle-forming die as claimed in claim 5, further comprising a locking device for maintaining said columnar body in a specified forming posture, said locking device comprising:

a locking block insertable between a portion of said columnar body and a portion of said lower die; and a driving member for moving said locking block into a position abutting said portion of said columnar body and said portion of said lower die.

7. A negative angle-forming die comprising:

a lower die for mounting a thin plate workpiece onto a supporting portion thereof;

an upper die descendable in a straight direction towards the lower die for forming the workpiece by abutting against the workpiece;

a columnar body arranged in a freely rotating manner on the lower die, said columnar body having an intruding forming portion formed at an edge portion thereof;

a slide cam having an intruding forming portion, said slide cam being arranged to oppose the columnar body in a freely sliding manner with respect to the lower die;

an automatic returning tool arranged at the lower die for retracting the columnar body in a rotating manner to an extent with which the workpiece can be taken out from the lower die upon completion of forming, wherein the workpiece that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed workpiece can be taken out from the lower die;

a first cylindrical bearing support surface located in said lower die;

a first cylindrical shaft located at a first end of said columnar body; and a first cylindrical bearing located between said first cylindrical bearing support and said first cylindrical shaft for supporting said columnar body in a freely rotating manner.

8. The negative angle-forming die as claimed in claim 7, further comprising:

a second cylindrical bearing support surface located in said lower die;

a second cylindrical shaft located at a second end of said columnar body; and a second cylindrical bearing located between said second cylindrical bearing support and said second cylindrical shaft for supporting said columnar body in a freely rotating manner.

9. The negative angle-forming die as claimed in claim 7, wherein said columnar body is supported by a support located between both ends of said columnar body.

10. The negative angle-forming die as claimed in claim 8, further comprising:

a link fixedly attached to an end of said first cylindrical shaft; and a driving member arranged between said link and said lower die for moving said link to rotate said columnar body.

11. The negative angle-forming die as claimed in claim 10, wherein said driving device comprises a fluid cylinder having an extensible piston and rod assembly therein.

12. The negative angle-forming die as claimed in claim 7, further comprising a locking device for maintaining said columnar body in a specified forming posture.

13. The negative angle-forming die as claimed in claim 12, said locking device comprising:

a locking block insertable between a portion of said columnar body and a portion of said lower die; and a driving member for moving said locking block into a position abutting said portion of said columnar body and said portion of said lower die.

14. The negative angle-forming die as claimed in claim 13, wherein said driving member comprises a fluid cylinder having an extensible piston and rod therein, said locking block being located at one end of said rod.

15. The negative angle-forming die as claimed in claim 7, wherein said columnar body has a part-circular arcuate portion which extends over approximately 90° of a circular arc.

16. A negative angle-forming die comprising:

a lower die for mounting a thin plate workpiece onto a supporting portion thereof;

an upper die descendable in a straight direction towards the lower die for forming the workpiece by abutting against the workpiece;

a columnar body arranged in a freely rotating manner on the lower die, said columnar body having an intruding forming portion formed at an edge portion thereof;

a slide cam having an intruding forming portion, said slide cam being arranged to oppose the columnar body in a freely sliding manner with respect to the lower die; and an automatic returning tool arranged at the lower die for retracting the columnar body in a rotating manner to an extent with which the workpiece can be taken out from the lower die upon completion of forming, wherein the workpiece that is mounted on the supporting portion of the lower die is formed through the intruding forming portion of the columnar body and the intruding forming portion of the slide cam while the slide cam performs sliding movements, and after completion of forming, the columnar body is retracted in a rotating manner by the automatic returning tool such that the formed workpiece can be taken out from the lower die, wherein a connecting portion between the columnar body and the lower die is an arc having a length substantially equal to a quarter of a circle.

17. The negative angle-forming die as claimed in claim 16, wherein the columnar body abuts against a hitting surface of the lower die when forming the workpiece.

18. The negative angle-forming die as claimed in claim 16, wherein said intruding forming portion of the columnar body is disposed on a side of said columnar body opposing said connecting portion between said columnar body and said lower die.

19. The negative angle-forming die as claimed in claim 16, further comprising:

a first cylindrical bearing support surface located in said lower die;

a second cylindrical bearing support surface located in said lower die;

a first cylindrical shaft located at a first end of said columnar body;

a second cylindrical shaft located at a second end of said columnar body;

a first cylindrical bearing located between said first cylindrical bearing support and said first cylindrical shaft for supporting said first end of said columnar body in a freely rotating manner; and a second cylindrical bearing located between said second cylindrical bearing support and said second cylindrical shaft for supporting said second end of said columnar body in a freely rotating manner.

20. The negative angle-forming die as claimed in claim 16, further comprising a locking device for maintaining said columnar body in a specified forming posture, said locking device comprising:

a locking block insertable between a portion of said columnar body and a portion of said lower die; and a driving member for moving said locking block into a position abutting said portion of said columnar body and said portion of said lower die.

* * * * *